US011421466B2

(12) United States Patent
Hu

(10) Patent No.: US 11,421,466 B2
(45) Date of Patent: Aug. 23, 2022

(54) HINGE WITH FUNCTION OF ELECTRICALLY OPENING AND CLOSING DOOR

(71) Applicant: FOSHAN SHUNDE NUOWEI ELECTRIC CO. LTD, Guangdong (CN)

(72) Inventor: Guoheng Hu, Guangdong (CN)

(73) Assignee: FOSHAN SHUNDE NUOWEI ELECTRIC CO. LTD, Foshan (CN)

( * ) Notice: Subject to any disclaimer, the term of this patent is extended or adjusted under 35 U.S.C. 154(b) by 85 days.

(21) Appl. No.: 16/971,140

(22) PCT Filed: Apr. 19, 2019

(86) PCT No.: PCT/CN2019/083363

§ 371 (c)(1),
(2) Date: Aug. 19, 2020

(87) PCT Pub. No.: WO2020/098221

PCT Pub. Date: May 22, 2020

(65) Prior Publication Data

US 2021/0002942 A1 Jan. 7, 2021

(30) Foreign Application Priority Data

Nov. 15, 2018 (CN) ..... 201811362121.5

(51) Int. Cl.
*E05F 1/08* (2006.01)
*E05F 15/619* (2015.01)
(Continued)

(52) U.S. Cl.
CPC ..... *E05F 15/619* (2015.01); *E05F 15/622* (2015.01); *E05F 1/1276* (2013.01); *E05Y 2900/308* (2013.01); *E05Y 2900/31* (2013.01)

(58) Field of Classification Search
CPC ..... E05F 15/619; E05F 15/622; E05F 15/627; E05F 1/1276; E05Y 2900/308; E05Y 2900/31; E05Y 2900/30; E05D 11/00
See application file for complete search history.

(56) References Cited

U.S. PATENT DOCUMENTS 10,745,953 B2 * 8/2020 Xu ..... E05F 1/105
2018/0073291 A1 * 3/2018 Vanini ..... E05F 3/20
(Continued)

FOREIGN PATENT DOCUMENTS

CN 204728876 U 10/2015
CN 205314773 U 6/2016
(Continued)

*Primary Examiner* — Jerry E Redman
(74) *Attorney, Agent, or Firm* — Dragon Sun Law Firm, PC; Linggao Li, Esq.; Nathaniel Perkins

(57) ABSTRACT

A hinge with a function of electrically opening and closing a door is disclosed, including a main body and a trigger flexibly articulated to the main body. An accommodation slot exists in the main body, a lever and a bracing are mounted in the accommodation slot, one end of the lever is flexibly articulated to the trigger, the other end of the lever is articulated to the bracing, the other end of the bracing is flexibly disposed in the accommodation slot through a guide pin, a spring is disposed in the accommodation slot, one end of the spring is connected to the lever, and the other end is connected to the main body. An electric drive apparatus is mounted on the main body, and is connected to the bracing, and the electric drive apparatus drives the bracing to move in the accommodation slot, and indirectly drives the trigger to swing. Beneficial effects of the present disclosure are: by driving the lever to move in the accommodation slot, the electric drive apparatus indirectly drives the trigger to swing, so as to implement the opening and closing of a cabinet door.

4 Claims, 3 Drawing Sheets

(51) Int. Cl.
*E05F 15/622* (2015.01)
*E05F 1/12* (2006.01)

(56) References Cited

U.S. PATENT DOCUMENTS

| | | | | |
|---|---|---|---|---|
| 2018/0163443 | A1* | 6/2018 | Park | E05F 1/1261 |
| 2019/0203947 | A1* | 7/2019 | Meurer | F24C 15/023 |

FOREIGN PATENT DOCUMENTS

| | | | | | |
|---|---|---|---|---|---|
| CN | 107288474 | A | * | 10/2017 | B60J 5/10 |
| CN | 109184401 | A | | 1/2019 | |
| EP | 1961901 | A2 | * | 8/2008 | E05F 1/1261 |
| EP | 2927603 | A1 | * | 10/2015 | A47J 37/0664 |
| EP | 3073038 | A1 | * | 9/2016 | E05F 1/1261 |
| EP | 3293332 | A1 | * | 3/2018 | E05D 3/18 |
| JP | 2003003738 | A | | 1/2003 | |
| WO | WO-2014111827 | A1 | * | 7/2014 | E05F 1/1261 |
| WO | WO-2020133824 | A1 | * | 7/2020 | |

* cited by examiner

HINGE WITH FUNCTION OF ELECTRICALLY OPENING AND CLOSING DOOR

TECHNICAL FIELD

The present disclosure relates to a hinge, and in particular, to a hinge with a function of electrically opening and closing a door.

BACKGROUND

With rapid development of the society, people's quality of life keeps improving. Especially, people pay great attention to diet. Making food at home has become a living habit of many citizens. All kinds of appliances such as ovens and microwave ovens are applied in people's homes. Conventionally, doors of the appliances are manually opened and closed. Therefore, it is necessary to automate the opening and closing of the doors. Most existing appliance manufacturers have accepted a hinge structure as a major type of structure for opening and closing doors. Therefore, if the existing structure is changed and a brand-new structure is designed, the new structure is inadaptable to the existing products, increases research and development costs and production costs, and brings other problems. Therefore, the structure needs to be further improved.

SUMMARY

An objective of the present disclosure is to overcome disadvantages of the prior art, and provide a hinge with a function of electrically opening and closing a door, with the hinge being simple-structured and cost-effective, generating low energy consumption and low noise, and being capable of automatically opening and closing the door.

The objective of the present disclosure is achieved by the following technical solutions: a hinge with a function of electrically opening and closing a door, including a main body and a trigger flexibly articulated to the main body, where: an accommodation slot exists in the main body, a lever and a bracing are mounted in the accommodation slot, one end of the lever is flexibly articulated to the trigger, the other end of the lever is articulated to the bracing, the other end of the bracing is flexibly disposed in the accommodation slot through a guide pin, a spring is disposed in the accommodation slot, one end of the spring is connected to the lever, and the other end is connected to the main body; and an electric drive apparatus is mounted on the main body, and is connected to the bracing, and the electric drive apparatus drives the bracing to move in the accommodation slot, and indirectly drives the trigger to swing.

The electric drive apparatus is an electric screw driven by a deceleration motor, the electric screw is screwed to a threaded hole on a connection plate, and the other end of the connection plate is articulated to the bracing.

The electric drive apparatus is a toothed plate connected to a tail end of the bracing, and a deceleration motor disposed on the main body drives a gear to mesh with the toothed plate.

The electric drive apparatus is an electric expansion lever, a main unit of the electric expansion lever is fixed to the main body, and a drive lever of the electric expansion lever is connected to the bracing.

A connection plate is also disposed between the drive lever of the electric expansion lever and the bracing, one end of the connection plate is articulated to the bracing, and the other end is articulated to the drive lever.

Beneficial effects of the present disclosure are: 1. The structure is simple, the production cost is low, and market competitiveness is improved; 2. by driving the lever to move in the accommodation slot, the electric drive apparatus indirectly drives the trigger to swing, so as to implement the opening and closing of a cabinet door; 3. an electric mechanism can drive the opening and closing of the hinge, so as to implement automatic opening and closing of the cabinet door, thereby being convenient for a user to operate and improving a profile of a product to which the hinge is applied; 4. without a need to change an original structure of the cabinet door, the hinge meshes with existing hinge structures seamlessly, and is rapidly applicable; 5. using a spring force on a hinge structure, a door can be opened and closed by configuring only an electric drive apparatus of a low power. This brings advantages in multiple aspects. One advantage is that an energy-saving effect is achieved by opening and closing the door through an electric drive apparatus of a low power. Another advantage is that noise generated during the opening and closing of the door is reduced. In addition, the hinger can match a variety of cabinet doors by only changing spring tension, thereby making the hinge universally applicable.

DESCRIPTION OF EMBODIMENTS

Figure 1:
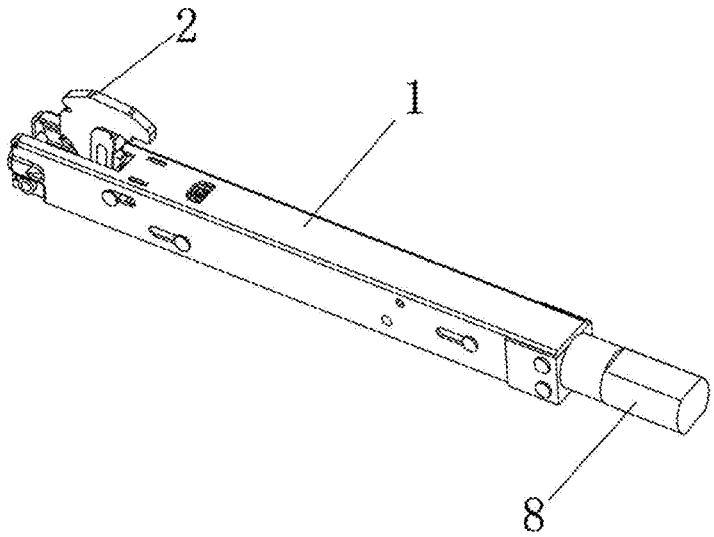
FIG. 1 is a schematic diagram of a whole assembly structure according to Embodiment 1 of the present disclosure.

The following describes the present disclosure in further detail with reference to accompanying drawings. A hinge with a function of electrically opening and closing a door is disclosed, including a main body 1 and a trigger 2 flexibly articulated to the main body. An accommodation slot 3 exists in the main body 1, and a lever 4 and a bracing 5 are mounted in the accommodation slot 3. One end of the lever 4 is flexibly articulated to the trigger 2, and the other end of the lever is articulated to the bracing 5. The other end of the bracing 5 is flexibly disposed in the accommodation slot 3 through a guide pin 6. A spring 7 is disposed in the accommodation slot 3. One end of the spring 7 is connected to the lever 4, and the other end is connected to the main body 1. An electric drive apparatus is mounted on the main body 1, and is connected to the bracing 5, and the electric drive apparatus drives the bracing 5 to move in the accommodation slot 3, and indirectly drives the trigger 2 to swing.

Embodiment 1

Figure 2:
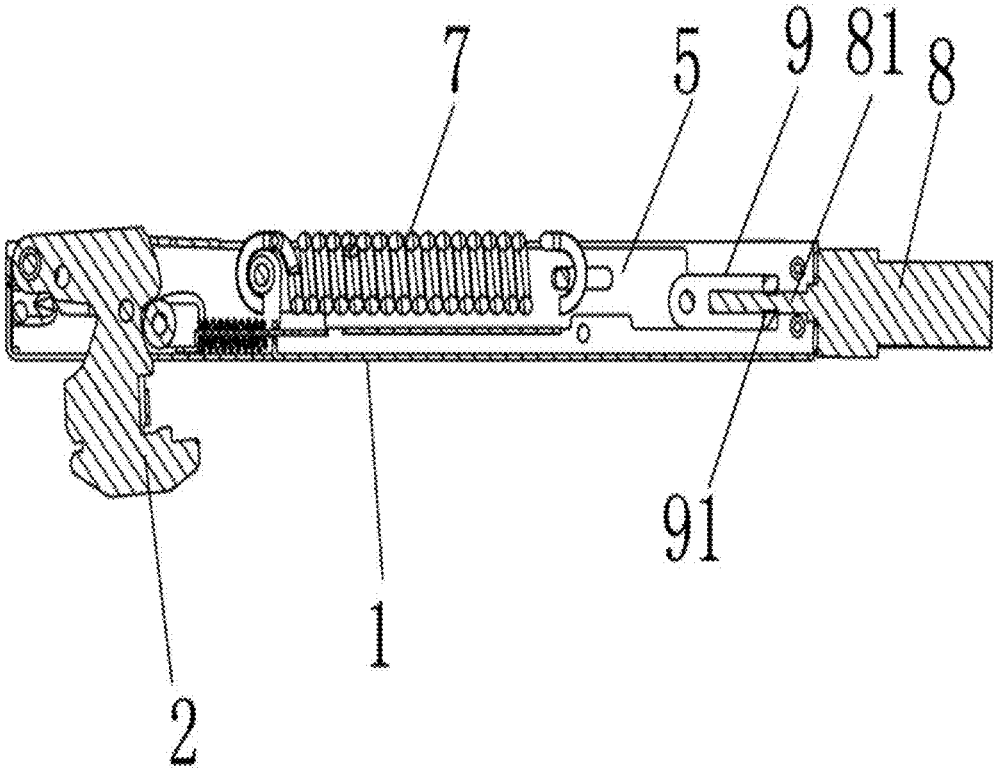
FIG. 2 is a cutaway diagram of a whole assembly structure according to Embodiment 1 of the present disclosure.
Figure 3:
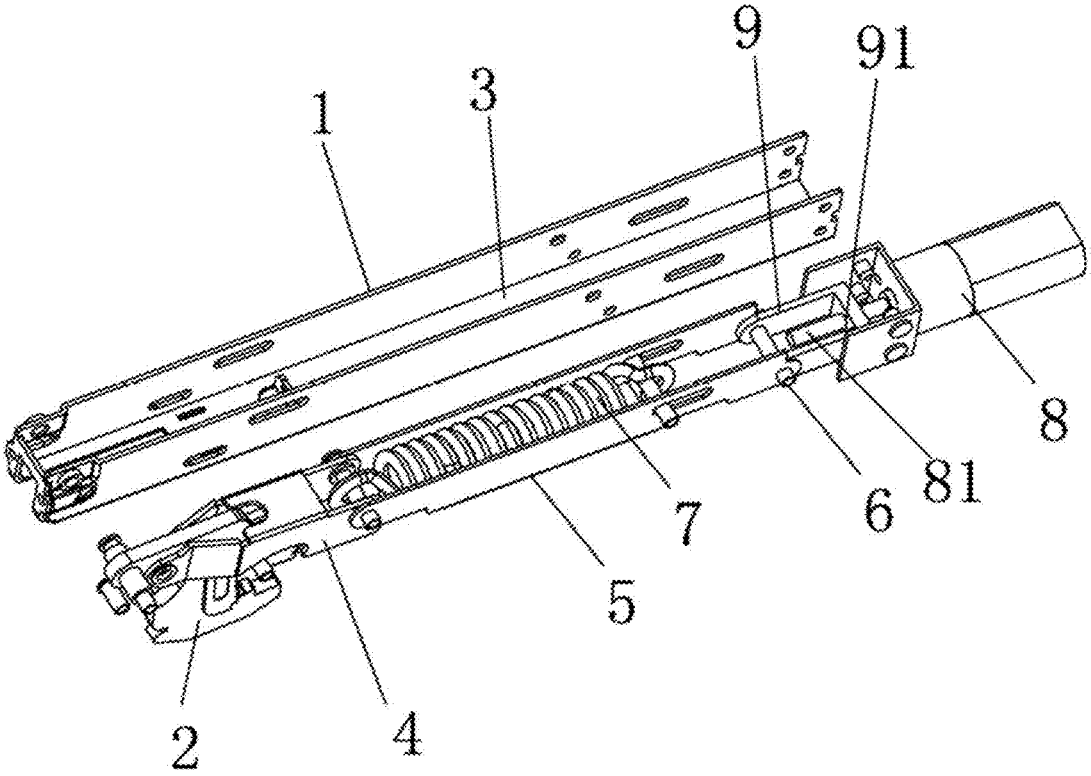
FIG. 3 is a structural assembly diagram according to Embodiment 1 of the present disclosure.

As shown in FIG. 1, FIG. 2, and FIG. 3, the electric drive apparatus is an electric screw 81 driven by a deceleration motor 8. The electric screw 81 is screwed to a threaded hole 91 on a connection plate 9. The other end of the connection plate 9 is articulated to the bracing 5. When a cabinet door needs to be opened or closed, a control system energizes the electric screw 81 to make it rotate. During rotation, the electric screw is screwed to the threaded hole 91 on the connection plate 9 to drive movement of the connection plate. The connection plate drives movement of a bracing, so as to drive a trigger to swing, and finally implement opening and closing of the cabinet door.

Embodiment 2

Figure 4:
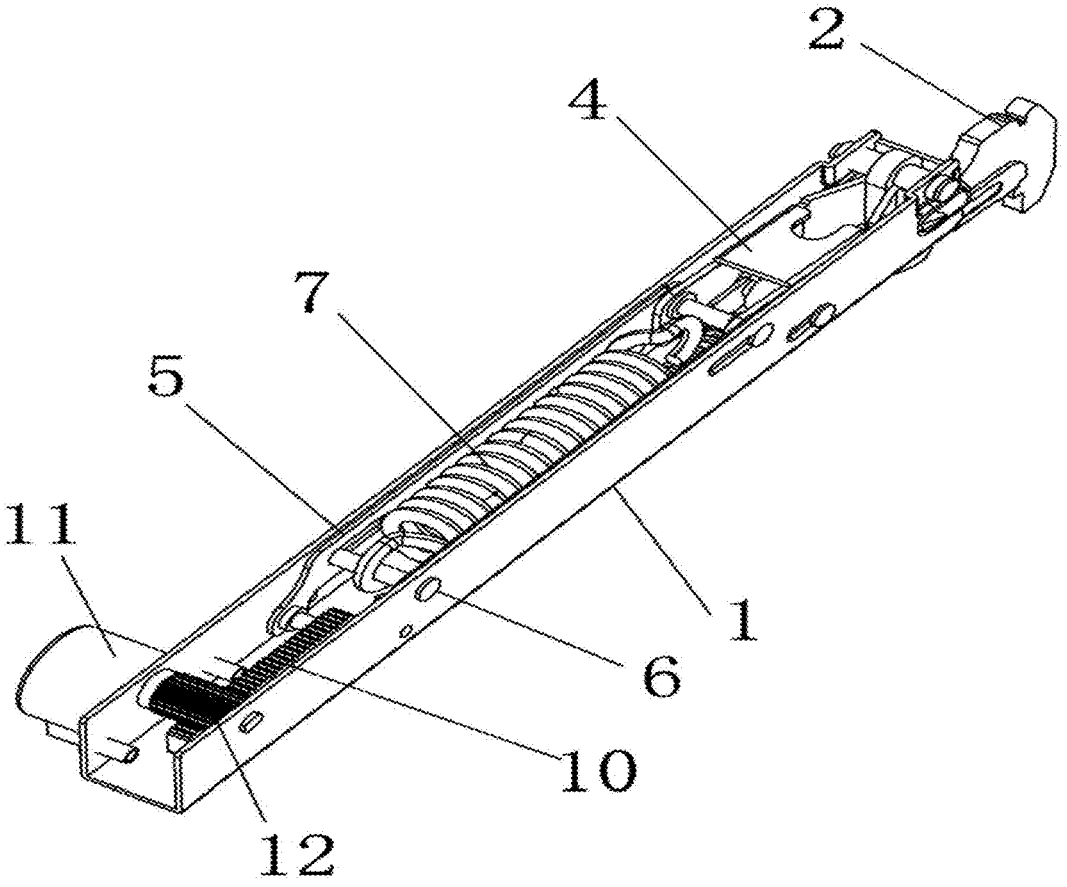
FIG. 4 is a schematic diagram of a whole assembly structure according to Embodiment 2 of the present disclosure.
Figure 5:
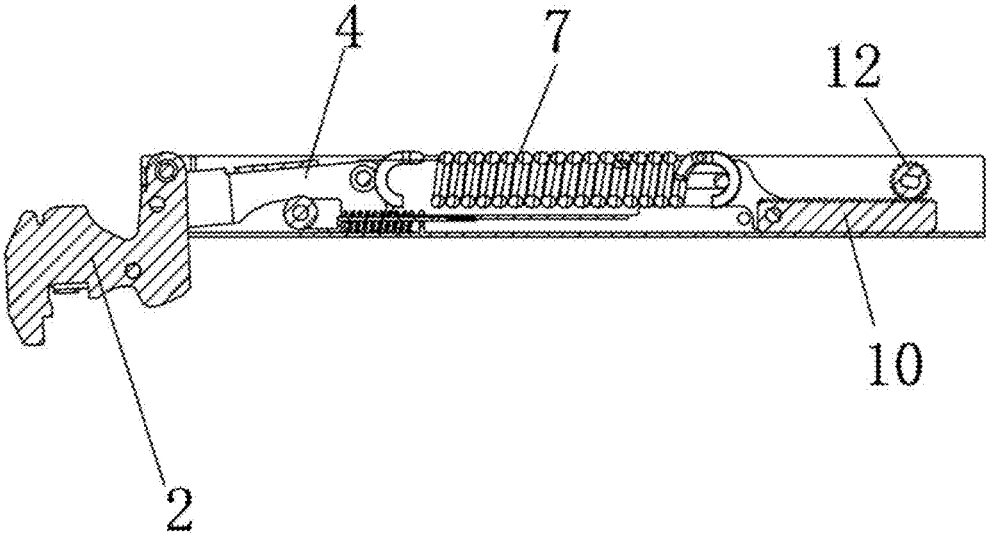
FIG. 5 is a cutaway diagram of a whole assembly structure according to Embodiment 2 of the present disclosure.

As shown in FIG. 4 and FIG. 5, the electric drive apparatus is a toothed plate 10 connected to a tail end of a bracing 5. A deceleration motor 11 disposed on the main body 1 drives a gear 12 to mesh with the toothed plate 10. When a cabinet door needs to be opened or closed, a control system energizes the deceleration motor to make it rotate. During rotation, the deceleration motor propels the drive gear 12 to rotate. During rotation, the drive gear 12 propels the toothed plate 10 to move linearly, thereby driving movement of the bracing and driving a trigger to swing, and finally implementing the opening and closing of the cabinet door.

Embodiment 3

The electric drive apparatus is an electric expansion lever. A main unit of the electric expansion lever is fixed to a main body 1, and a drive lever of the electric expansion lever is connected to a bracing 5. When a cabinet door needs to be opened or closed, a control system energizes the electric expansion lever so that the expansion lever moves telescopically. The telescopic movement drives movement of the bracing, drives a trigger to swing, and finally implements the opening and closing of the cabinet door.

A connection plate 9 is also disposed between the drive lever of the electric expansion lever and the bracing 5. One end of the connection plate is articulated to the bracing 5, and the other end is articulated to the drive lever.

In general, the opening and closing of the cabinet door in the above three embodiments are implemented by the electric drive apparatus by changing a parallel force of a spring during an opening or closing process of the door, where the parallel force matches a weight of the door.

Compared with the conventional technology, the hinge in this disclosure can implement automatic opening or closing of a door under an effect of the electric drive apparatus. Therefore, during use of a product which involves a cabinet door and to which the hinge is applied, such as an oven, a microwave oven, or a refrigerator, the cabinet door is automatically opened and closed under control of an electric control system. While being convenient for a user to operate, the hinge improves smartness and use experience of the product, and therefore, is widely applicable.

The foregoing illustrates and describes basic principles, main features, and advantages of the present disclosure. A person skilled in the art understands that the present disclosure is not limited by the above embodiments. The embodiments and the specification only describe the principles of the present disclosure. All variations and improvements made to the present disclosure without departing from the principles and scope of the present disclosure shall fall within the scope of the claims of the present disclosure.

What is claimed is:

1. A hinge with a function of electrically opening and closing a door, comprising a main body (1) and a trigger (2) flexibly articulated to the main body, wherein: an accommodation slot (3) exists in the main body (1), a lever (4) and a bracing (5) are mounted in the accommodation slot (3), one end of the lever (4) is flexibly articulated to the trigger (2), an opposite end of the lever is articulated to the bracing (5), one end of the bracing (5) is flexibly disposed in the accommodation slot (3) through a guide pin (6), a spring (7) is disposed in the accommodation slot (3), one end of the spring (7) is connected to the lever (4), and an opposite end of the spring (7) is connected to the main body (1); and an electric drive apparatus is mounted on the main body (1), and is connected to the bracing (5), and the electric drive apparatus drives the bracing (5) to move in the accommodation slot (3), and indirectly drives the trigger (2) to swing;

wherein the electric drive apparatus is an electric screw (81) driven by a deceleration motor (8), the electric screw (81) is screwed to a threaded hole (91) on a connection plate (9), and an opposite end of the connection plate (9) is articulated to the bracing (5).

2. The hinge with a function of electrically opening and closing a door according to claim 1, wherein the electric drive apparatus is a toothed plate (10) connected to a tail end of the bracing (5), and a deceleration motor (11) disposed on the main body (1) drives a gear (12) to mesh with the toothed plate (10).

3. The hinge with a function of electrically opening and closing a door according to claim 1, wherein the electric drive apparatus is an electric expansion lever, a main unit of the electric expansion lever is fixed to the main body (1), and a drive lever of the electric expansion lever is connected to the bracing (5).

4. The hinge with a function of electrically opening and closing a door according to claim 3, wherein a connection plate (9) is also disposed between the drive lever of the electric expansion lever and the bracing (5), one end of the connection plate is articulated to the bracing (5), and the other end is articulated to the drive lever.

* * * * *